US006051154A

United States Patent [19]

Meyer

[11] Patent Number: 6,051,154

[45] Date of Patent: Apr. 18, 2000

[54] FIRE FIGHTING FOAMS UTILIZING SAPONINS

[75] Inventor: David Jeffrey Meyer, Mittagong, Australia

[73] Assignee: Orion Safety Industries PTY Limited, Liverpool, Australia

[21] Appl. No.: 09/117,908

[22] PCT Filed: Feb. 7, 1997

[86] PCT No.: PCT/AU97/00066

§ 371 Date: Mar. 10, 1999

§ 102(e) Date: Mar. 10, 1999

[87] PCT Pub. No.: WO97/28846

PCT Pub. Date: Aug. 14, 1997

[30] Foreign Application Priority Data

Feb. 8, 1996 [AU] Australia ..... PN7960

[51] Int. Cl.[7] ..... A62C 31/02; A62C 2/00

[52] U.S. Cl. ..... 252/3; 252/8.05; 169/44

[58] Field of Search ..... 252/3, 8.05; 169/44

[56] References Cited

U.S. PATENT DOCUMENTS

| | | | |
|---|---|---|---|
| 3,022,251 | 2/1962 | Thiegs | 536/3 |
| 4,999,119 | 3/1991 | Norman et al. | 252/3 |
| 5,132,030 | 7/1992 | Marx | 252/2 |
| 5,207,932 | 5/1993 | Norman et al. | 252/3 |
| 5,391,721 | 2/1995 | Hanen et al. | 536/3 |
| 5,534,164 | 7/1996 | Guglielmi | 252/8 |
| 5,824,238 | 10/1998 | Garcia et al. | 252/8.05 |

OTHER PUBLICATIONS

Abstract for Japenese Publication 71006280. Assigned to Dailkin Kogyo, 1971.

Abstract for Japenese Publication 53145398. Assigned to Fudad Kogyo, Dec. 1978.

*Primary Examiner*—Gabrielle Brouillette
*Assistant Examiner*—La Toya Cross
*Attorney, Agent, or Firm*—Abelman, Frayne & Schwab

[57] ABSTRACT

A fire fighting foam formulation includes a non-foam forming amount of a saponin, such as a tri-terpene type saponin. The formulation may be an aqueous film forming foam (of either the alcohol resistant type or non-alcohol resistant type) which use a synthetic hydrocarbon surfactant as a foaming agent, a fluorocarbon surfactant to suitably lower the surface tension, and a non-ionic hydrocarbon surfactant to lower the amount of fluorocarbon surfactant required. The saponin significantly improves the heat resistance of the foam formulation when applied to fires, and can eliminate the need to use the non-ionic hydrocarbon surfactant. The saponin can replace part of the hydrocarbon surfactant component of the formulation so that a reduced amount of hydrocarbon surfactant is required in the formulation. The preferred concentration range of saponin in the formulation is between 0.3% and 1% by volume.

4 Claims, No Drawings

FIRE FIGHTING FOAMS UTILIZING SAPONINS

This application is 371 of PCT/AU97/00066, filed Feb. 7, 1997.

FIELD OF INVENTION

This invention relates to fire fighting foams and, more particularly, to fire fighting foam formulations utilising saponins to significantly improve the heat resistance of these foam formulations, to serve as synergists to the surfactants used in these foam formulations, and more specifically, to substantially reduce foam formulation viscosity in alcohol resistant type foam formulations.

BACKGROUND ART

Saponins are a group of sapogenin glycosides obtainable from many plants. Each saponin consists of a sapogenin which constitutes the aglucon moiety of the molecule and a sugar. The sapogenin may be a steroid or a tri-terpene and the sugar moiety may be glucose, galactose, a pentose or a methylpentose. Aqueous solutions of saponins foam like soap on shaking and are used, inter alia, as detergent.

Saponins were used in very early fire fighting foams as foaming agents but have long since been discontinued due to their high cost, which makes them unsuitable for use as foaming agents, given the existence of cheaper alternatives.

Synthetic fire fighting foam formulations, such as aqueous film forming foams (of either the alcohol resistant type or non-alcohol resistant type), high expansion foams and class A foams (which includes forest fire foams) use a synthetic hydrocarbon surfactant or detergent as a foaming agent. Aqueous film forming foams (AFFF's), in particular, consist of both synthetic hydrocarbon surfactant foaming agents and a fluorocarbon surfactant added to lower the surface tension.

The basic concept behind AFFF formulations is that it is possible to float a film of water on top of a lower density hydrocarbon fuel if the surface tension is sufficiently low and the interfacial tension between the two liquids is in the appropriate range. The fluorocarbon surfactant is able to achieve this low surface tension.

Aqueous film forming foams also use a non-ionic hydrocarbon surfactant, which is usually of the ethoxylated octyl phenol type (such as TRITON X 102), in combination with the fluorocarbon surfactant to lower the level of fluorocarbon surfactant required. Without the addition of the non-ionic hydrocarbon surfactant, higher levels of the relatively expensive fluorocarbon surfactant is required. Alkyl polyglycoside surfactants can also be used to replace the ethoxylated octyl phenol type surfactant.

A typical 6% AFFF formulation of the prior art has the following general composition:

| COMPONENT | RANGE |
|---|---|
| Fluorocarbon Surfactant | 0.5% to 2% |
| Amphoteric Hydrocarbon Surfactant | 1% to 5.5% |
| Anionic Hydrocarbon Surfactant | 0% to 2.5% |
| Non Ionic Hydrocarbon Surfactant | 0.5% to 2% |
| Glycol/Glycol Ether | 2% to 10% |
| Buffer | 0% to 2% |
| Sequestrant | 0% to 1% |
| Corrosion Inhibitor | 0% to 2% |
| Water | Balance |

A limitation of hydrocarbon surfactants resides in the heat resistance of the foam produced. Furthermore, fluorocarbon surfactants are very expensive and not particularly environmentally friendly.

We have found that the use of low levels of a saponin can significantly improve the heat resistance of the foam and provide economic advantages in relation to the ability to use less amounts of other components of the foam. For instance, when low levels of saponins are used in an AFFF formulation, the non-ionic hydrocarbon surfactant is not required. Saponins have been found to be more effective than either ethoxylated octyl phenol type or alkyl polyglycoside type surfactants for this purpose. In addition, the saponin component replaces part of the hydrocarbon surfactant component of the foam. For saponin to completely replace the hydrocarbon surfactant would require a concentration of greater than 15% (by weight) in the foam concentrate formulation. (prior to mixing with water to form the foam formulation) and this is not currently practical or desirable as saponins are relatively expensive when compared to hydrocarbon surfactants. The use of saponin also enables a reduction in the amount of fluorcarbon surfactant that needs to be used in the formulation, with resultant cost savings and improved environmental safety.

Also, when relatively low levels of saponins are added to the foam concentrate formulation—up to about 2% (by weight) but depending on the desired mixing ratio for the foam concentrate formulation in water when used for fire fighting—the heat resistance of the foam formulation produced from the concentrate formulation is surprisingly improved.

For instance, we have found that the performance of alcohol resistant AFFF (ARAFFF) formulations can be improved significantly by the use of low levels of saponin in the formulation. Alcohol resistant aqueous film forming foams (ARAFFF's) are synthetic fire fighting foam formulations with special additives to make the foam resistant to break down by polar solvents, such as alcohols or ketones, which normally break down other types of fire fighting foams. Polar solvents destroy these other types of foams by rapidly drawing water from the foam bubbles. Loss of water is rapid and results in loss of bubble strength until the bubble bursts. ARAFFF's, however, use a polymer additive to resist the drawing of water from the foam by the polar solvents. Most ARAFFF's use a high molecular weight polysaccharide, such as Xanthan gum, which slows the loss of water from the foam and forms a floating raft of thick gel which traps the bubbles on top of the polar solvent. This raft insulates the foam above it and protects subsequently applied foam from water loss.

A typical 6% ARAFFF formulation of the prior art has the following general composition:

| COMPONENT | RANGE |
|---|---|
| Fluorocarbon Surfactant | 1.0% to 4% |
| Amphoteric Hydrocarbon Surfactant | 0% to 5.5% |
| Anionic Hydrocarbon Surfactant | 0% to 5.5% |
| Non Ionic Hydrocarbon Surfactant | 0.5% to 1% |
| Glycol/Glycol Ether | 2% to 10% |
| High Molecular Weight Polysaccharide | 0.5% to 1.3% |
| Bactericide | 0.1% to 1% |
| Magnesium Sulphate | 0% to 0.5% |
| Urea | 0% to 2% |
| Buffer | 0% to 2% |
| Sequestrant | 0% to 1% |
| Corrosion Inhibitor | 0% to 2% |
| Water | Balance |

The polysaccharides desired to be used in ARAFFF formulations result in a foam concentrate formulation with a very high viscosity. The very high viscosity of these concentrates makes them difficult to handle and it is difficult to produce highly concentrated products which can be used with water at the most desired 3% or lower foam formulation concentrations. To date, the concentrates which are capable of being used at this level are generally based on a very expensive polysaccharide.

However, highly concentrated products remain desirable because they reduce the effective cost of the foam concentrate formulation and can reduce the total cost of foam fire fighting installations. One known method of manufacturing more concentrated ARAFFF's is to use between 1% and 20% of a polyglycoside surfactant to improve the performance in such a way that the viscosity of the final product is lower.

The most common ARAFFF's are designed for mixing with water at 6 parts foam concentrate to 94 parts water (a 6% concentrate). Products which work when mixed at 3 parts concentrate to 97 parts water (a 3% concentrate) generally have an unsatisfactorily high viscosity.

We have found that the use of a much smaller percentage of saponins in ARAFFF formulations can achieve a 3% concentrate with a satisfactory viscosity.

When relatively low levels of saponins are added to the ARAFFF concentrate formulation, (up to about 2% (by weight) but depending on the desired mixing ratio for the foam concentrate formulation in water when used for fire fighting) the ARAFFF formulation is able to use less polysaccharide while achieving the same performance.

The addition of saponins in this way to ARAFFF formulations also enables less fluorocarbon surfactant to be used.

SUMMARY OF THE INVENTION

According to one aspect of the invention there is provided a fire fighting foam formulation which includes a non-foam forming amount of a saponin. Preferably, the saponin is present in an amount sufficient to substantially reduce the surfactant concentration of the formulation. The saponin may be present in the foam concentrate formulation at less than 15% (by weight), but less than 2% (by weight) is preferred for the foam formulation to achieve a 6% (by volume) proportioned product when mixed with water.

PREFERRED MODES FOR CARRYING OUT THE INVENTION

In order that the invention may be more readily understood and put into practical effect, reference will now be made to the following examples.

EXAMPLE 1

Two non-alcohol resistant AFFF formulations—HF6114 and HF6115—were prepared with compositions (percent by volume) as follows:

| COMPONENT | HF6114 | HF6115 |
|---|---|---|
| Forafac 1157N (27%) | 5.5% | 4.0% |
| Miranol J2MSF (40%) | 5.0% | 5.0% |
| Texapon 842 (40%) | 6.0% | 6.0% |
| Henkel APG-225 (50%) | 1.2% | 1.2% |
| Miritaine CBS (40%) | 7.0% | 7.0% |
| Sequestrant | 0.08% | 0.08% |
| Buffer | 0.1% | 0.1% |
| Corrosion Inhibitor | 0.2% | 0.2% |

-continued

| COMPONENT | HF6114 | HF6115 |
|---|---|---|
| Butyl Di Icinol | 6.0 | 6.0 |
| Saponin | — | 0.65% |
| Water | Balance | Balance |

Forafac 1157N is a fluorocarbon surfactant, Miranol J2MSF is an amphoteric alkyl amino di-carboxylate surfactant, Texapon 842 is an anionic sodium octyl sulphate surfactant, Henkel APG-225 is a non-ionic alkyl polyglycoside surfactant and Miritaine CBS is an amphoteric hydrocarbon surfactant. Butyl Di Icinol is a glycol ether.

Formulations HF6114 and HF6115 were tested in accordance with Australian Defence Specification DEF(Aust) 5603D which requires a control time on the cyclic fire test of a minimum of 400 seconds.

Formulation HF6114 achieved a result of 401 seconds while HF6115 achieved a result of 407 seconds. The replacement of 1.5% of the fluorocarbon surfactant Forafac 1157N by 0.65% saponin represents a considerable cost saving. A comparative test using the HF6115 formulation without the saponin achieved a test result of less than 360 seconds.

The fire test used to test the foam formulations mainly tests the heat resistance of the foam. The test uses a 10 liter cylinder of foam which is sprayed through an extinguisher on a circular fire test tray. The discharge of foam is stopped when the fire is controlled (about 70% reduction in radiant heat) and, after the discharge, the foam continues to reduce the radiant heat to about 25% of the peak value. When the fire burns off enough foam for the radiant heat level to rise to 30% of the maximum intensity, more foam is applied, again until it is controlled. The discharge is then stopped again. This process is continued until the extinguisher is empty and the heat radiation again rises to 30% of the maximum intensity. The time this takes is the control time and the specification requires 400 seconds, minimum. This tests the heat resistance of the foam and the ability of the foam to flow, both of which factors are critical to the foam's success. There is very little difference in the flow properties of the foam with or without the saponin, but there is an obvious and significant overall increase in total control time for the saponin containing foam, which is attributed to improved heat resistance of that foam.

The saponin used in formulation HF6115 was a tri-terpene type but other saponins may be used.

EXAMPLE 2

Two alcohol resistant AFFF (ARAFFF) formulations—PF7667 and PF7682—were prepared with compositions (percent by volume) as follows:

| COMPONENT | PF7667 | PF7682 |
|---|---|---|
| Forafac 1157N (27%) | 3.5% | 3.0% |
| Miranol J2MSF (40%) | 4.0% | 3.8% |
| Texapon 842 (40%) | 4.0% | 2.0% |
| Henkel APG-225 (50%) | 1.2% | 1.2% |
| Miritaine CBS (40%) | 4.0% | 3.0% |
| Sequestrant | 0.2% | 0.2% |
| Rhodopol R23 (Xanthan Gum) | 1.0% | 0.9% |
| Locust Bean Gum | — | 0.25% |
| Magnesium Sulphate | 0.2% | 0.2% |

-continued

| COMPONENT | PF7667 | PF7682 |
|---|---|---|
| Urea | 1.0% | 0.5% |
| Bactron B6 | 0.2% | 0.2% |
| Buffer | 0.1% | 0.3% |
| Corrosion Inhibitor | 0.2% | 0.2% |
| Butyl Di Icinol | 4.0% | 4.0% |
| Saponin | — | 0.5% |
| Water | Balance | Balance |

These products were tested on a circular fire test tray with ethanol fuel having a diameter of 1.6 m. A UK fire research 5 liter per minute foam branchpipe was used to generate the foam. The resulting foam application rate is 2.5 lpm/$m^2$. The fire must be extinguished in less than 120 seconds. Some products which are UL listed fail this test. Formulation PF7667 failed to extinguish the test fire in 120 seconds, while formulation PF7682 extinguished the test fire in approximately 95 seconds.

EXAMPLE 3

6% ARAFFF formulations prepared in accordance with this invention have the following general composition:

| COMPONENT | RANGE | PREFERRED |
|---|---|---|
| Fluorocarbon Surfactant | 1.0% to 4% | 2% to 3.5% |
| Amphoteric Hydrocarbon Surfactant | 0% to 12% | 2% to 8% |
| Anionic Hydrocarbon Surfactant | 0% to 8% | 2% to 4% |
| Non-Ionic Hydrocarbon Surfactant | 0.5% to 1% | 0.5% to 1.0% |
| Glycol/Glycol Ether | 2% to 10% | 2% to 5% |
| High Molecular Weight Polysaccharide | 0.5% to 1.2% | 0.9% to 1.1% |
| Bactericide | 0.1% to 1% | 0.1% to 0.5% |
| Magnesium Sulphate | 0% to 0.5% | 0.1% to 0.5% |
| Urea | 0% to 2% | 0.4% to 1.0% |
| Buffer | 0% to 2% | 0.1% to 0.5% |
| Sequestrant | 0% to 1% | 0.1% to 0.5% |
| Corrosion Inhibitor | 0% to 2% | 0.1% to 0.5% |
| Saponin | 0.1% to 2% | 0.3% to 1% |
| Water | Balance | Balance |

EXAMPLE 4

A 3% ARAFFF formulation in accordance with this invention was prepared with a composition (percent by volume) as follows:

| COMPONENT | PF7384 |
|---|---|
| Forafac 1157N (27%) | 6.0% |
| Miranol J2MSF (40%) | 6.0% |
| Texapon 842 (40%) | 7.6% |
| Henkel APG-225 (50%) | 2.0% |
| Miritaine CBS (40%) | 3.0% |
| Sequestrant | 0.2% |
| Rhodopol R23 (Xanthan Gum) | 1.5% |
| Locust Bean Gum | 0.5% |
| Magnesium Sulphate | 0.2% |
| Urea | 0.5% |
| Bactron B6 | 0.2% |
| Buffer | 0.3% |
| Corrosion Inhibitor | 0.2% |
| Butyl Di Icinol | 4.0% |
| Saponin | 1.0% |
| Water | Balance |

This formulation extinguished the test fire in approximately 115 seconds.

EXAMPLE 5

3% ARAFFF formulations prepared in accordance with this invention have the following general composition:

| COMPONENT | RANGE | PREFERRED |
|---|---|---|
| Fluorocarbon Surfactant | 2.0% to 8% | 4% to 7% |
| Amphoteric Hydrocarbon Surfactant | 0% to 15% | 5% to 9% |
| Anionic Hydrocarbon Surfactant | 0% to 12% | 5% to 10% |
| Non-Ionic Hydrocarbon Surfactant | 0.5% to 2% | 0.8% to 1.2% |
| Glycol/Glycol Ether | 2% to 10% | 3% to 5% |
| High Molecular Weight Polysaccharide | 0.9% to 2% | 1% to 1.5% |
| Bactericide | 0.1% to 1% | 0.1% to 0.5% |
| Magnesium Sulphate | 0% to 0.5% | 0.1% to 0.5% |
| Urea | 0% to 2% | 0.4% to 1.0% |
| Buffer | 0% to 2% | 0.1% to 0.5% |
| Sequestrant | 0% to 1% | 0.1% to 0.5% |
| Corrosion Inhibitor | 0% to 2% | 0.1% to 0.5% |
| Saponin | 0.1% to 2% | 0.3% to 2% |
| Water | Balance | Balance |

In conclusion, we have ascertained that there is a synergistic relationship between the saponins and surfactants present in the formulations of this invention that provides a surprising and significant reduction in the amount of surfactants needed for effective fire fighting performance, and a considerable improvement in the heat resistance of the foam formulations. Furthermore, ARAFFF's containing saponins in accordance with this invention may be prepared having substantially reduced viscosity. Generally, the saponin containing fire fighting foam formulations of the present invention exhibit superior fire fighting capabilities when compared with similar prior art products formulated without saponins.

Various modifications may be made to details of the composition of the fire fighting foam formulations, processes for preparing these formulations and methods of their use without departing from the scope or ambit of the invention.

What is claimed is:

1. A fire fighting foam formulation comprising a surfactant and a non-foam forming amount of saponin, said saponin being present in an amount of 0.1% to 15.0%, by weight, of said formulation, and wherein said surfactant includes a fluorocarbon surfactant, said saponin co-operating with said fluorocarbon surfactant to provide said formulation with a reduced fluorocarbon surfactant concentration and increased heat resistance.

2. The formulation of claim 1 wherein the saponin is present between 0.1% and 2% by volume of the formulation.

3. The formulation of claim 2 wherein the saponin is present between 0.3% and 1% by volume of the formulation.

4. The formulation of claim 1 which is an alcohol resistant aqueous film forming foam formulation and wherein the saponin cooperates with said fluorocarbon surfactant to provide said formulation with a reduced viscosity.

* * * * *